US005354110A

United States Patent [19]

Licata

[11] Patent Number: 5,354,110

[45] Date of Patent: Oct. 11, 1994

[54] FIREPLACE TONGS

[76] Inventor: Francis S. Licata, 8783 Chestnut Ridge Rd., Gasport, N.Y. 14067

[21] Appl. No.: 139,014

[22] Filed: Oct. 21, 1993

[51] Int. Cl.[5] ..... A47J 49/00

[52] U.S. Cl. ..... 294/11; 294/104

[58] Field of Search ..... 294/10, 11, 19.1, 22, 294/8.5, 50.8, 50.9, 104

[56] References Cited

U.S. PATENT DOCUMENTS

| | | | |
|---|---|---|---|
| 1,519,938 | 12/1924 | Smith | 294/104 X |
| 1,630,013 | 5/1927 | Hyatt | 294/11 |
| 1,820,463 | 8/1931 | Klein | 294/11 |
| 2,125,214 | 7/1938 | Apfel et al. | 294/11 |
| 2,279,809 | 4/1942 | Apfel | 294/11 |
| 4,105,238 | 8/1978 | Stright | 294/11 |

*Primary Examiner*—Johnny D. Cherry
*Attorney, Agent, or Firm*—Wallace F. Neyerlin

[57] ABSTRACT

The fireplace tending tool is of tubular construction with a hand grip and actuating lever, both of which can be squeezed together with one hand. The actuating lever is connected by means of a solid rod inside the tube to a moveable jaw construction which jaw is of curved design. The moveable jaw is made from flat bar steel and possesses a single tooth at its outer end. This moveable jaw opposes two similar shaped fixed jaws or tines constructed of round steel with a curved design similar to the curve of the moveable jaw. These two fixed jaws and the moveable jaw are fabricated of welded steel and fixed about the center line of the tube at the tube's end opposite from the end of the tube where the hand grip and actuating lever are located. The overall design the device provides for 180 degree movement of same in the placing of logs and in operating the device. Due to its lightweight design and streamlined contour, maximum leverage and control is attained during operation.

16 Claims, 4 Drawing Sheets

5
6
7
8
9
10
11
12
13
15
17
19
20
21
22
23
24
26
26a
2
2'
6a
7a

FIREPLACE TONGS

FIELD OF THE INVENTION

This invention relates to a "fireplace tending" tool. More specifically, the invention relates to a very efficient hand actuated tool with greatly improved mechanical advantage properties for such functions as inserting logs, rearranging burning logs and for damper adjustment, as compared to other fireplace tending tools on the market known to applicant.

A search in the United States Patent Office was carried out in order to ascertain the novelty of the fireplace tending tool of the present invention. Several patents were selected as having some relevancy to the device of the present invention but the devices of these patents, either singly or in combination, were not considered to be anticipatory of the device of this application.

The search was conducted in Class 294, subclasses 10, 11, 50.8, 50.9 and 103.1. The following patents considered the most relevant, were selected and the specific features considered relevant to the tool of the present invention are summarized.

| U.S. Pat. No. | Inventor | Issue Date |
|---|---|---|
| 842,420 | O. O. Petty | 1/29/07 |

Relevant Features
handle 15 actuates pull rod 8, enclosed within hollow tube 1, for pivoting lever 6 about pivot 7

| | | |
|---|---|---|
| 1,061,175 | Guy & Blom | 5/6/13 |

Relevant Features
handle 6 operates pull rod 11 for pivoting gripping member 9

| | | |
|---|---|---|
| 1,630,013 | C. D. Hyatt | 5/24/27 |

Relevant Features
a first class lever for moving tong 5 through squeezing action upon hand grip 9

| | | |
|---|---|---|
| 2,279,809 | Apfel | 4/14/42 |

Relevant Features
tongs for use with a fire box. A first class lever action operates tong 17 through a pulling action on actuator rod 32, as is best shown in FIGS. 4 and 2

| | | |
|---|---|---|
| 2,905,498 | Lunde | 9/22/59 |

Relevant Features
a very similar arrangement for a first class lever as Apfel's. See the bottom prongs 15 and moveable member 14 in FIG. 1. Spring 30 is attached directly to the moveable member, rather than to the pull rod, as in the previous patent

| | | |
|---|---|---|
| 3,105,705 | Happ | 10/1/63 |

Relevant Features
fixed member (13 or 21) and opposing moveable member 14 form a first class lever action operated by pull rod 16

A separate search was also carried out in the Buffalo, New York Public Library by the inventor of this patent application and the following patents were noted by him as being related to implements for manipulating and carrying fire logs or the like; but the devices of these patents also are not considered to be anticipatory of the device of this application: U.S. Pat. Nos. 4,105,238; 4,223,933; 4,225,170; 4,225,174; 4,240,657; 4,252,357; 4,307,909; 4,355,831; 4,449,743; 4,478,449; 4,932,698; and 5,121,956.

SUMMARY OF THE PRESENT INVENTION

The fireplace tending tool is of tubular construction with a hand grip and actuating lever, both of which can be squeezed together with one hand. The actuating lever is connected by means of a solid rod inside the tube to a moveable jaw construction which jaw is of curved design. The moveable jaw is made from flat bar steel and possesses a single tooth at its outer end. This moveable jaw opposes two similar shaped fixed jaws or tines constructed of round steel with a curved design similar to the curve of the moveable jaw. These two fixed jaws and the moveable jaw are fabricated of welded steel and fixed about the center line or axis of the tube handle at the tube's end opposite from the end of the tube where the hand grip and actuating lever are located. This overall design of the device provides for 180 degree movement same in the placing of logs and in operating the device. Due to its lightweight design and streamlined contour, maximum leverage and control is attained during operation. The tool enables its users to insert, move, rearrange logs, adjust the damper, etc. in fireplaces, overcoming problems encountered in using cumbersome and difficult to control tongs. It is also much safer to use than tongs when handling burning logs or inserting logs.

The movable jaw of the gripping section of the tool is opened by a slight movement of the hand lever away from the handle and the gripping section is then positioned over a log, artificial or real. With the squeezing of the lever toward the handle, the firewood is grasped and held for positioning and placed into the fireplace or repositioned after being so placed and while burning.

The tube handle is typically about 35" long and is constructed of steel. The tube fulfills the need to enable the user to grasp burning logs and move them about in a fireplace with control, as if the user were using his hand in the fireplace and eases the chore fire tending and eliminates the dangerous use of cumbersome tongs.

The curve of the moveable jaw of the device is essentially a radius of about 6" to suit the handling of average size logs and split firewood. The moveable jaw has no gripping teeth at its midsection, the absence of which allows the log or split firewood to be rotated to a comfortable position by adjustment of the jaws with the hand grip. The moveable jaw and the fixed jaws are of fabricated steel to eliminate breakage which is more likely to occur if the jaws were constructed of cast iron. The curve of the upper moveable jaw and the lower fixed jaws are of the same (approximately) 6" radius to facilitate being able to flip logs and burning embers 180 in the fireplace and to be able to release the logs with the same safe results. The one and only tooth on the moveable jaw can additionally be used to adjust the fireplace damper whether it be of lever action or of slide action type. Each end of the lower fixed jaws also has a tooth. The tube of the device is crushed or squeezed into a smaller cross-section near its gripping portion and a narrow pathway is provided in the linkage so as to limit the maximum amount that the moveable jaw can be opened away from the fixed jaws.

The pull rod in the device is mounted only about $1\frac{3}{8}''$ down the actuator lever from a pivot pin location on the tube. This thus restricts the axial movement of the pull rod to only about 0.25 to about 0.75 inches, typically 0.5 inches while at the same time forcing the moveable jaw to move its maximum distance away from the fixed jaws when the actuator lever is pushed away from the handle by the user of the device. The tubular portion of the device has two rather limited bends in same, making it streamlined acting, increasing control and leverage and also aiding in the ability to flip logs 180 degrees. Through the use of two key pivot or fulcrum points, a three to one ratio of movement of the moveable jaw away from the fixed jaws as compared to the distance movement of the actuating lever toward the handle is derived.

The fixed jaws are typically constructed of wrought iron steel, each with a tooth at its tip to secure or grasp items to be placed or moved in the fireplace. The device uses double tined fixed jaws which are spaced from each other and curved. The actuator rod is enclosed in the tube, presenting no hazards, such as clothing being caught in moving parts, in the operation of the device and also requiring no spring. The device uses tubing formed so as to facilitate the use of an enclosed actuator rod and also to provide comfortable hand grip design. The single tooth used in the moveable jaw enables it to be used for damper adjustment as well as to provide a final grip in order to insert a log or relocate a burning log. The lower fixed jaws also each have a small tooth on same in order to eliminate slippage of the object being inserted or relocated. The moveable jaw stop of the device is used to control the maximum opening and closing of the jaw.

The invention and its advantages will be best further described and understood by reference to the attached drawings.

BRIEF DESCRIPTION OF THE DRAWING

FIGS. 5 and 6 also illustrate movement of rod and parts of the device described further in the detailed description of the drawings and how the device operates.

Figures 5, 6, 6A:
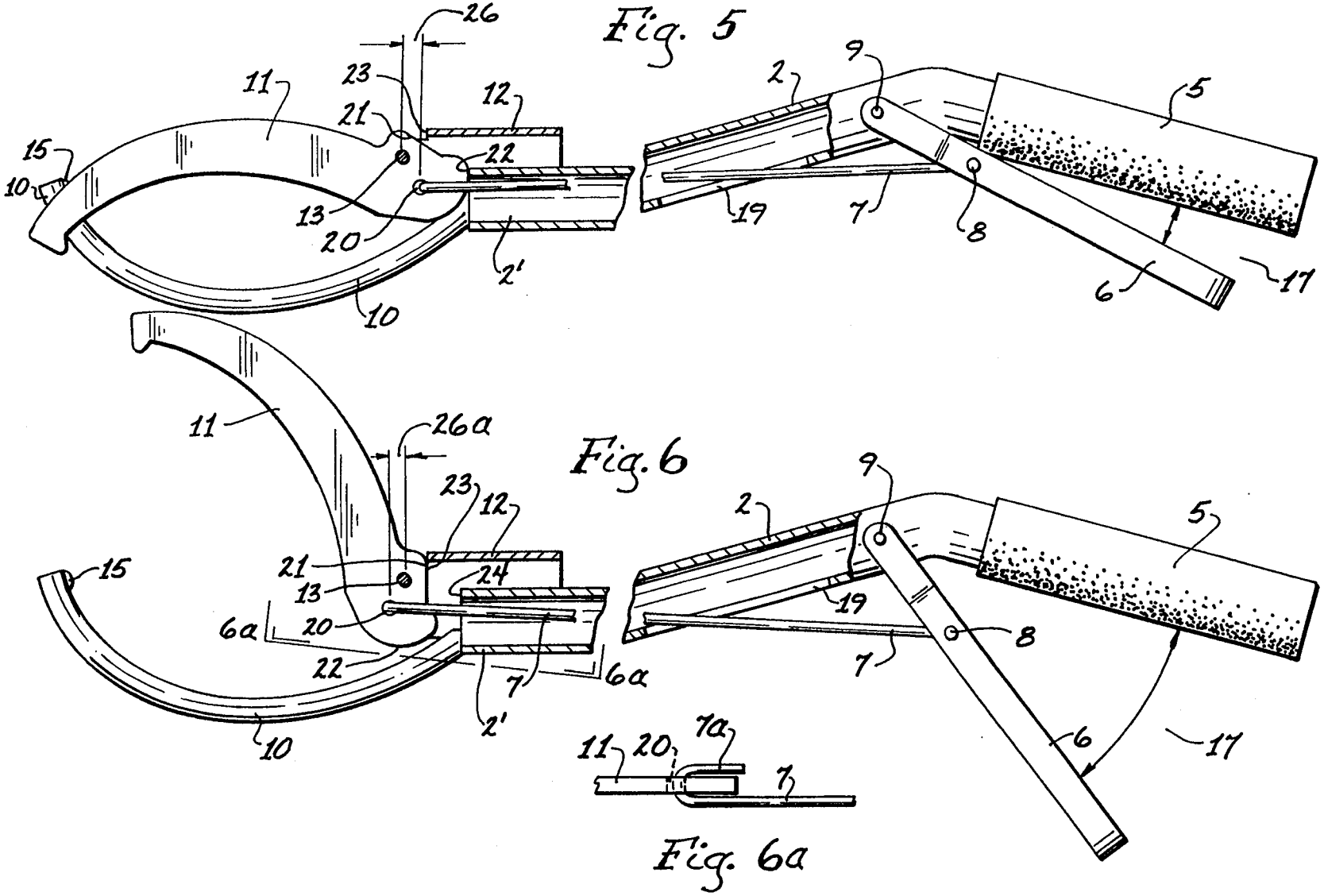
FIG. 5 is a partial (broken) sectional view of the device of the present invention illustrating the tool with the "jaws" of the gripping portion of the device in their gripping or closed position.
FIG. 6 is a partial (broken) sectional view of the device illustrating the tool with the jaws in their open position.

FIG. **6*a* is an enlarged bottom view of a part of the gripping portion of the device taken across line *6a—6a* of FIG. 6**.

Figure 7:
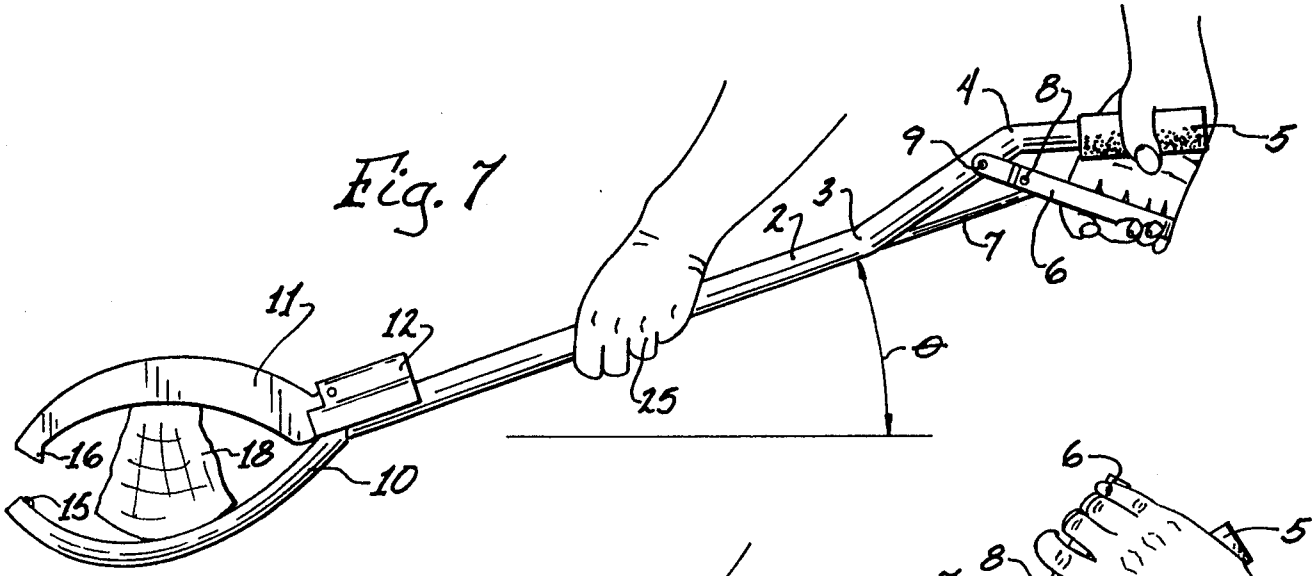
Figure 8:
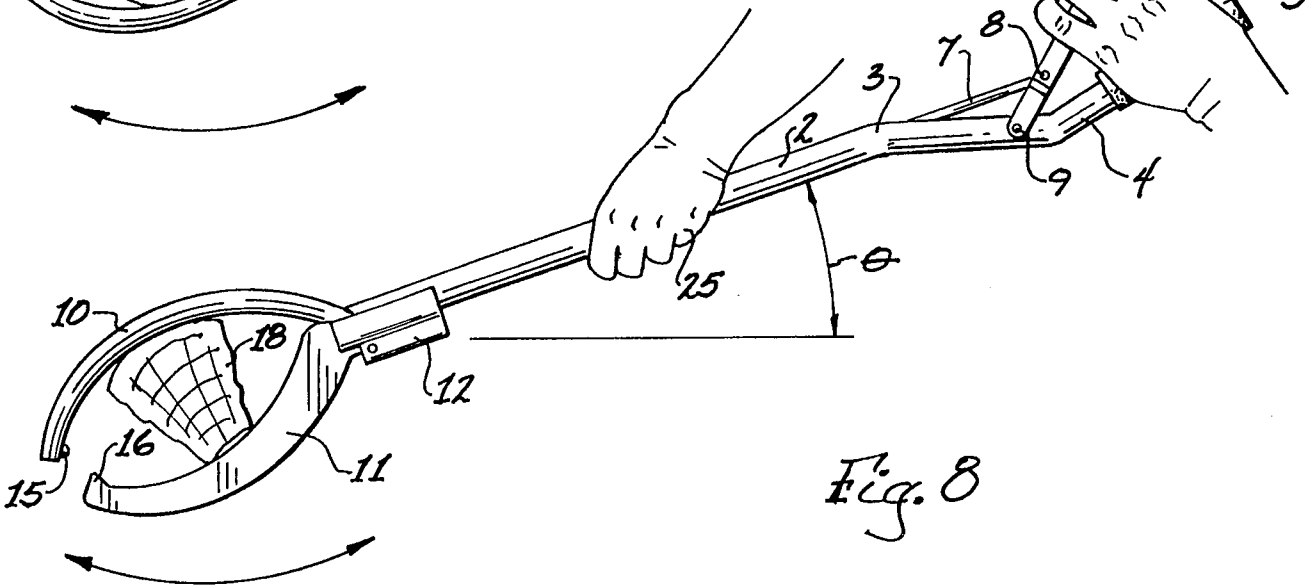

FIG. 7 is a side view of the device with its fixed "jaws" on the underside of the gripping portion; and FIG. 8 is also a side view of the device wherein the device is "flipped" 180 degrees so that the fixed jaws are at the top of the gripping portion. FIGS. 7 and 8 also illustrate the profile similarity of the fixed and hinged jaws, the gripping of a piece of wood by the device and the typical placement of the hands by the operator of the device.

DETAILED DESCRIPTION OF THE DRAWINGS AND THE PREFERRED EMBODIMENTS

Figure 1:
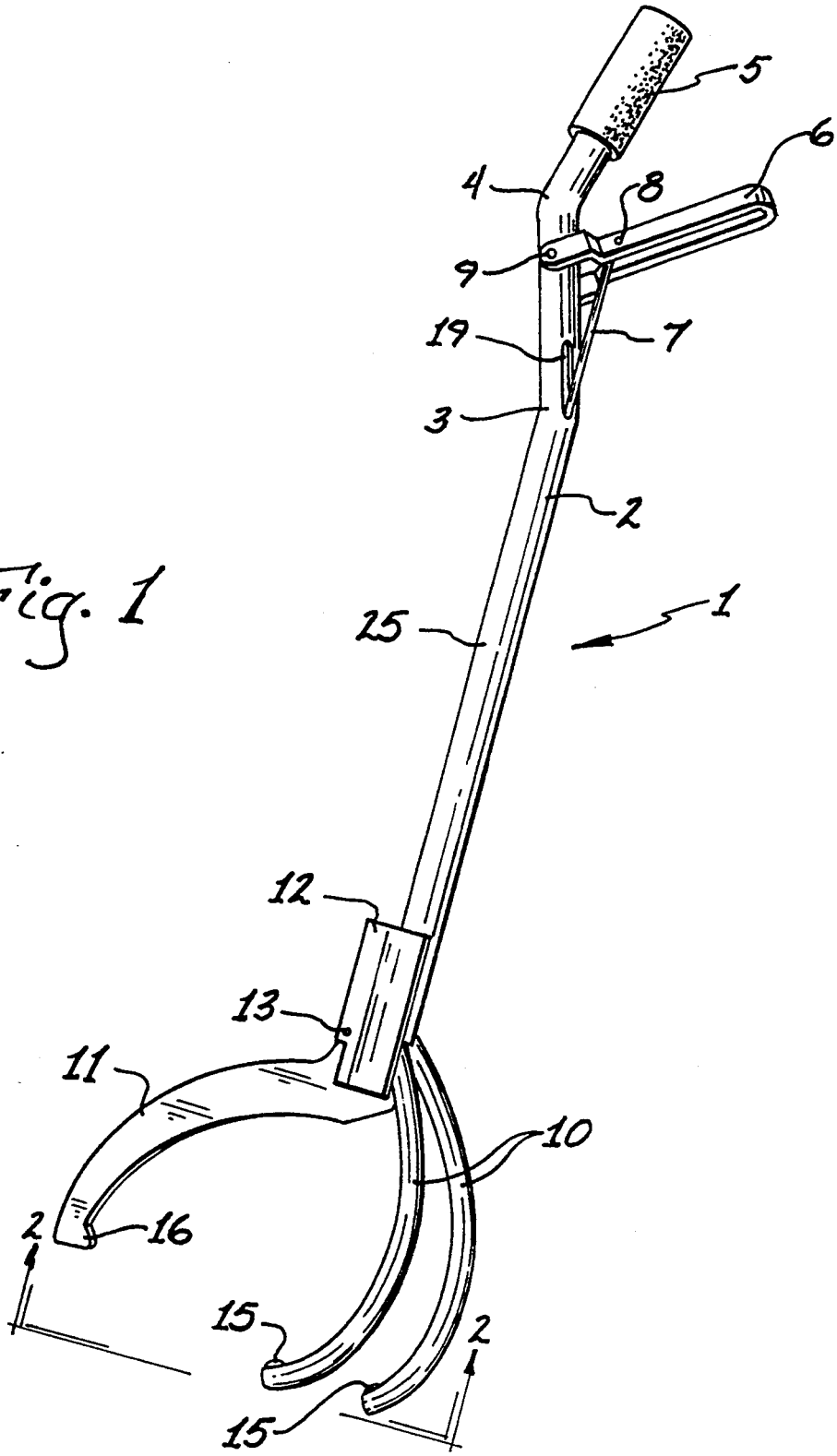
FIG. 1 is a perspective view of the entire device of the present invention.
Figure 2:
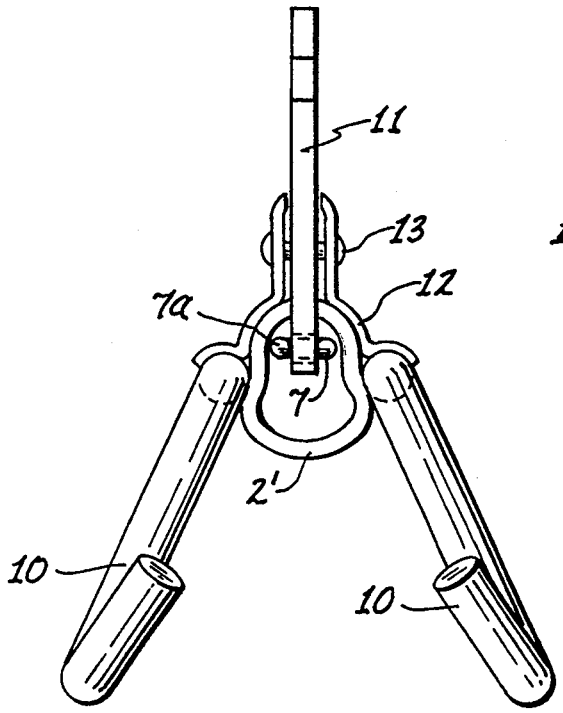
FIG. 2 is an end view of the gripping portion of the device of the present invention taken along line 2—2 of FIG. 1.

The specific features of the device are now described in more detail. The entire device of the present invention is designated by the numeral 1. Numeral 2 designates the main tube portion of the device. Numeral 2' refers to a deformed portion of the tube near the jaws of the device. Numerals 3 and 4 refer to bends in the tube near the handle portion of the device as illustrated in FIGS. 1, 7 and 8. Numeral 5 refers to the handle of the tool and numeral 6 refers to a control lever near the handle. The construction and dimensions are such that the user of the tool can easily grip around both the handle and the lever to operate the jaws of the gripping portion of the tool with one hand. Numeral 17 (in FIGS. 5 and 6) refers to the distance varying gap between handle 5 and lever 6 in the operation of the tool. (The user of the tool will typically use his or her other hand to grasp the handle near its midpoint, i.e. near area 25 as shown in FIGS. 1, 7 and 8 in order to bear the weight of the log being inserted into or adjusted in the fireplace). Numeral 7 refers to an actuator rod which moves axially through slot opening 19 and within tube 2 when the user of the tool squeezes the handle 5 and lever 6 together or conversely releases his grip between these two members of the tool, or forces lever 6 away from handle 5. Rod 7 is connected to lever 6 by means of a fastening pin 8. Lever 6 is preferably constructed as shown in FIG. 1 as a U shaped rectangle wherein the rod is fitted within the two sides of the rectangular lever with the pin 8 coupling the two members close to the tube 2 as shown. Pin 9, which attaches lever 6 to tube 2 as shown in FIG. 1, functions as a fulcrum about which lever 6 pivots as the user grips or releases his grip on the tool when operating it. Where rod 7 is connected to lever 6 by pin 8 is only about $1\frac{3}{8}$ inches from the handle portion at pin 9.

The gripping portion of the tool consists of two fixed jaws 10 and one hinged jaw 11. These are connected to tube 2 by means of a saddle 12 which is pinned to a deformed tube area 2'' of the tube by means of pin 13. (The gripping portion of the tool and its operation are described in more detail hereinafter with references to FIGS. 2–8). It should be noted that the actual movement of rod 7 is only a short distance within the tube when the user operates the device but that this slight movement is sufficient to control a much greater distance of movement of hinged jaw 11 away from the fixed jaws 10 of the gripping portion of the device. In other words, an axial movement of the rod 7 of only about $\frac{1}{2}$ inch can bring about a separation of hinged jaw 11 from the fixed jaws 10 typically of about 6–8 inches.

Figure 3:
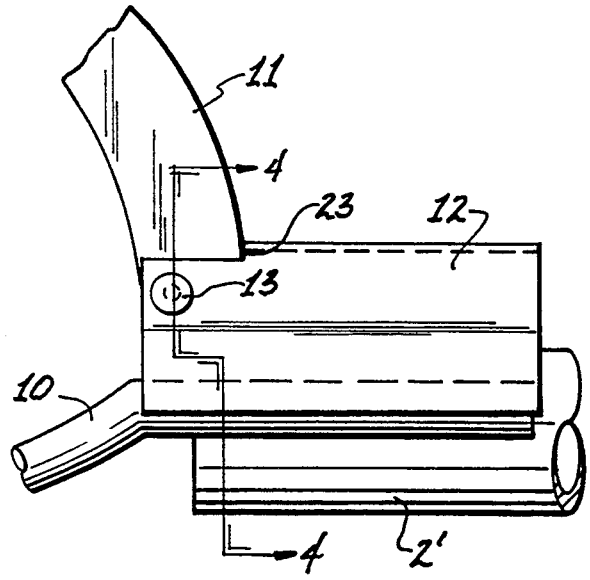
FIG. 3 is an enlarged partial side view of the gripping portion of the present invention illustrating the "saddle" area of the gripping portion of the tool of the present invention.
Figure 4:
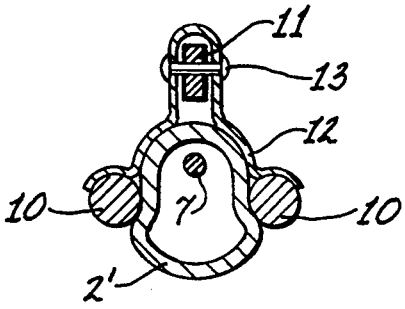
FIG. 4 is a cross-sectional view taken across line 4—4 of FIG. 3

Movement of hinged jaw 11 away from fixed jaws 10 is restricted or controlled by means of a notch 23 in saddle 12 so that the hinged jaw can only open so far before it butts against the main portion of saddle 12 as illustrated in FIG. 3. Pin 13, as illustrated in FIG. 1 and FIG. 3, serves to operate as a fulcrum about which the hinged jaw 11 swivels or pivots. The length of notch 23 in saddle 12 which serves to control the amount of opening of the hinged jaw from the fixed jaws 10 can, of course, be controlled in constructing the device, thus accounting for the typical (as desired) variation of from about 6 to 8 inches as previously mentioned.

The gripping portion of the device will preferably have "nubs" 15 near the ends of the fixed jaws 10 as illustrated in FIG. 1 and a "tooth" 16 near the end of the hinge jaw 11, also illustrated in FIG. 1. These serve to provide excellent control in the gripping end of the device for fastening or manipulating logs, etc.

Features of the device and its operation are made clearer by reference to FIGS. 5 and 6. Rod 7 goes back and forth within tube 2 through slot opening 19 in the tube. Rod 7 is operatively connected to hinged jaw 11 by passing through a hole 20 in the end of the jaw (near the end of the tube) and is curled back (*7a*) toward itself as illustrated in FIG. *6a* . The rod is typically round with a diameter of about ½ inch and the hole 20 has a diameter of about one inch so that the rod moves within the hole when the lever 6 is actuated by the user in order to cause jaw 11 to open from jaws 10 or close toward jaws 10. Numeral 12 is the saddle which surrounds the deformed portion 2'' of the tube, number 13 is the pin through the saddle and the hinged jaw (FIG. 4), number 24 is the end of the tube, number 23 is a notch slit or opening in 12 (FIG. 3), number 21 is a stop nub on jaw 11 which bumps against the end of the saddle 12 so as to limit the amount that the jaw can be opened, and number 22 is a curved portion of jaw 11 which bumps against the end of the deformed portion 2'' of the tube and limits the amount of movement of jaw 11 when closed toward jaws 10. Number 26 denotes the maximum linear distance that rod 7 moves in closing jaw 11 and number 26a denotes the maximum linear distance that rod 7 moves in opening jaw 11.

FIGS. 7 and 8 demonstrate the use of the tool in holding firewood 18 and the easy ability to flip the wood 180 degrees to accommodate the desired or ideal placing of the wood or burning log in the fireplace. The reversal of positions of bends 3 and 4 in these Figures and the substantially identical theta angle shown depict this 180 degree flipping of the device.

The device of the present invention is ideal for use in households with wood burning fireplaces or Franklin stoves and various other stoves. It functions very efficiently to insert or move or rearrange logs within the fireplace and can also be used to adjust dampers in the fireplace and avoids the use of cumbersome and difficult to control tongs which also require two hands to operate the handles of same.

Some of the important features of the present invention can be made clearer and emphasized by referring to the Apfel patent (U.S. Pat No. 2,279,809) referred to above. Apfel's device is referred to as "clinker tongs." The device of the present invention is to be used for handling logs, positioning embers, stocking fireplaces and Franklin stoves and also to adjust dampers whether they be of lever action or of slide action type. The curve of the moveable jaw of the device of the present invention typically is of a 6 inch radius so as to suit the handling of every size logs and split firewood. The moveable or hinged jaw of the device of the present invention has no gripping teeth in its interior surface such as the teeth 18 of Apfel's tongs, the absence of which teeth in the tool of the present invention allows the logs or the wood to be rotated to a comfortable position while holding the device with the handgrip. The jaws of the device of the present invention are made from steel so as to eliminate breakage of cast iron jaws. The curves of the upper moveable or hinged jaw and of the lower fixed jaws of the device of the present invention are of the same six inch radius to facilitate flipping logs and embers 180 degrees in the fireplace and releasing these logs with the same safe result. The lower jaws also have a tooth at one end, and one (and only one) tooth on the moveable jaw, which teeth near the ends of the jaws permit the easy log control referred to above and also the damper control referred to above. The device of the present invention also uses a partly crushed tube portion and narrow pathway to guide the linkage and moveable jaw in the event of wear so as not to bend, rather than a cast collar used only as a receptacle for the tube as in Apfel's device. Also the whole rod 7 of the device of the present invention is mounted only about one and three eighths inch down the actuator lever 6 from its pivot pin 9, not about 50% down the actuator lever as in Apfel's device. With reference to the handle 12 of Apfel's device, the handle of the device of the present invention has less bend in it than Apfel's handle, making it more streamlined acting, increasing the user's control and leverage, also adding in the ability to flip logs over a 180 degree angle. With consideration given to the fulcrum points 9 and 13 in the device of the present invention, the 3 to 1 ratio of the movement of the opposing jaws from each other in the present invention as compared to the axial movement of the actuator lever 7 is derived.

While the present invention has been described and illustrated in detail, various modifications may be made by those skilled in the art. It is therefore to be understood that the invention is not to be limited to the details of construction described and illustrated and it is intended by the appended claims to cover all modifications which fall within the spirit and scope of the invention.

I claim:

1. A fireplace tending tool, said tool comprising a hollow metal tube about three feet long; a handle at one end of the tube; a gripping mechanism at the other end of the tube; a lever affixed to the outer surface of the tube near the handle and located near enough to the handle that the person using the tool can grip both the lever and the handle with one hand; a solid metal rod attached at one end to the lever a distance of about 1 ⅜ inches from where the lever is attached to the tube and attached at its other end to a portion of the gripping mechanism, said rod being axially moveable a distance of only about ¼ to about ¾ inches within the hollow metal tube by the person using the tool when the user squeezes the lever toward the handle or forces the lever away from the handle by releasing his grip; and wherein axial movement of the solid rod within the metal tube causes desirable adjustable opening or closing of the gripping mechanism controlled by the single-handed gripping of the tool by the user; said gripping mechanism consisting of two fixed jaws and a moveable jaw fixed about the center line or axis of the tube, and the center of the gripping mechanism being substantially co-axial with the axis of the tube when the tool is used to grip an object by the tool's user.

2. A fireplace tending tool according to claim 1 wherein axial movement of the rod within the hollow metal tube is a distance of only about one half inch.

3. A fireplace tending tool according to claim 1 wherein the distance between the outer end of the handle and the outer end of the lever varies from about $\frac{3}{8}$ inch when the lever is in full closed position to about 3 $\frac{1}{2}$ inches when the lever is in full open position.

4. A fireplace tending tool according to claim 3 wherein the distance between the center of the handle and the center of the lever is about 2 $\frac{1}{2}$ inches in the full open position of the lever.

5. A fireplace tending tool according to claim 1 wherein the gripping mechanism includes means for limiting the maximum amount that the moveable jaw can be opened away from the fixed jaws.

6. A fireplace tending tool comprising: a hollow metal tube about three feet long; a handle at one end of the tube; a gripping mechanism at the other end of the tube; a lever affixed to the outer surface of the tube near the handle and located near enough to the handle that the person using the tool can grip both the lever and the handle with one hand; a solid metal rod attached at one end to the lever a distance of about 1 $\frac{3}{8}$ inches from where the lever is attached to the tube and attached at its other end to a portion of the gripping mechanism, said rod being axially moveable a distance of only about $\frac{1}{4}$ to $\frac{3}{4}$ inches within the hollow metal tube by the person using the tool when the user squeezes the lever toward the handle or forces the lever away from the handle by releasing his grip; wherein axial movement of the solid rod within the metal tube causes desirable adjustable opening or closing of the gripping mechanism controlled by the single-handed gripping of the tool by the user; wherein said gripping mechanism comprises a single moveable curved jaw pivotally opposed from two curved fixed jaws and wherein said gripping mechanism is fixed about the center line or axis of the tube, and the center of the gripping mechanism being substantially co-axial with the axis of the tube when the tool is used to grip an object by the tool's user.

7. A fireplace tending tool according to claim 6 wherein the curvatures of the single moveable jaw and of the fixed jaws are substantially identical.

8. A fireplace tending tool according to claim 6 wherein the moveable jaw and the fixed jaws each possess a nub near the outer ends of the jaws.

9. A fireplace tending tool, said tool comprising: a hollow metal tube about three feet long; a handle at one end of the tube; a gripping mechanism at the other end of the tube comprised of a saddle, two fixed jaws and a single moveable hinged jaw fixed about the center line or axis of the tube, and the center of the gripping mechanism being substantially co-axial with the axis of the tube when the tool is used to grip an object by the tool's user; a lever affixed to the outer surface of the tube near the handle and located near enough to the handle that the person using the tool can grip both the lever and the handle with one hand; a solid metal rod attached at one end to the lever a distance of about 1 $\frac{3}{8}$ inches from where the lever is attached to the tube and operatively and moveably connected at its other end through a hole in the hinged jaw portion of the gripping mechanism permitting pivotable movement of the rod within the hinged jaw; said rod being axially moveable a distance of only $\frac{1}{4}$ to about $\frac{3}{4}$ inches within the hollow metal tube by the person using the tool when the user squeezes the lever toward the handle or forces the lever away from the handle by releasing its grip; and wherein axial movement of the solid rod within the metal tube causes desirable adjustable opening or closing of the hinged jaw from the fixed jaws of the gripping mechanism controlled by the gripping of the handle and the lever of the tool by the user.

10. A fireplace tending tool according to claim 9 wherein axial movement of the rod within the hollow metal tube is a distance of only about one half inch.

11. A fireplace tending tool according to claim 9 wherein the distance between the outer end of the handle and the outer end of the lever varies from about $\frac{3}{8}$ inch when the lever is in full closed position to about 3 $\frac{1}{2}$ inches when the lever is in full open position.

12. A fireplace tending tool according to claim 11 wherein the distance between the center of the handle and the center of the lever is about 2 $\frac{1}{2}$ inches in the full open position of the lever.

13. A fireplace tending tool according to claim 9 wherein the jaws are curved and wherein the curvatures of the single moveable jaw and of the fixed jaws are substantially identical.

14. A fireplace tending tool according to claim 9 wherein the moveable jaw and the fixed jaws each possess a nub near the outer ends of the jaws.

15. A fireplace tending tool according to claim 9 wherein the saddle of the gripping mechanism includes means for variably controlling the maximum amount that the moveable jaw can be opened away from the fixed jaws.

16. A fireplace tending tool according to claim 9 wherein the solid metal rod is round with a diameter of about $\frac{1}{2}$ inch and wherein the hole in the hinged jaw portion of the gripping mechanism has a diameter of about one inch.

* * * * *